United States Patent [19]

Palac

[11] 4,084,193

[45] Apr. 11, 1978

[54] IMPLOSION PROTECTION SYSTEM FOR A CATHODE RAY TUBE WITH A FLANGELESS FACEPLATE

[75] Inventor: Kazimir Palac, Carpentersville, Ill.

[73] Assignee: Zenith Radio Corporation, Glenview, Ill.

[21] Appl. No.: 718,631

[22] Filed: Aug. 30, 1976

[51] Int. Cl.[2] ..... H01J 29/87

[52] U.S. Cl. ..... 358/246; 220/2.1 A

[58] Field of Search ..... 358/245, 246; 220/2.1 A

[56] References Cited

U.S. PATENT DOCUMENTS

| | | | |
|---|---|---|---|
| 3,519,161 | 7/1970 | Powell | 220/2.1 A |
| 4,004,092 | 1/1977 | Rogers | 358/246 |
| 4,016,364 | 4/1977 | Rogers | 358/245 |

*Primary Examiner*—Howard W. Britton
*Attorney, Agent, or Firm*—John H. Coult

[57] ABSTRACT

This disclosure depicts a color television picture tube having a glass bulb including a flangeless faceplate and a funnel with a convex seal land which mates with a concave inner surface of the faceplate. The tube has an implosion protection system comprising a tension member which surrounds the faceplate in straight lines between the faceplate corners. The system is characterized by the tension member being under tension to produce radially inwardly directed force components on the faceplate corners and by a lack of significant physical containment of the edge surface of the faceplate along the sides thereof.

7 Claims, 3 Drawing Figures

IMPLOSION PROTECTION SYSTEM FOR A CATHODE RAY TUBE WITH A FLANGELESS FACEPLATE

CROSS REFERENCE TO RELATED APPLICATIONS

This application relates to, but is not dependent upon, copending applications of common ownership herewith, including: Ser. No. 623,854, filed Oct. 20, 1975 (now U.S. Pat. No. 4,021,850, issued May 2, 1977); Ser. No. 623,852, filed Oct. 20, 1975 (now U.S. Pat. No. 4,004,092, issued Jan. 18, 1977); Ser. No. 639,741, filed Dec. 11, 1975 (now U.S. Pat. No. 4,037,255 issued July 19, 1977); Ser. No. 623,853, filed Oct. 20, 1975 (now U.S. Pat. No. 4,016,364 issued Apr. 4, 1977); and Ser. No. 632,559, filed Nov. 17, 1975 (now U.S. Pat. No. 4,012,772).

This invention relates to a system for implosion protecting color television picture tubes which have a flangeless faceplate. Conventionally, color television picture tubes have an evacuated glass bulb which includes a faceplate with a rearward flange and a funnel sealed to the faceplate flange along a planar sealing interface. The faceplate has a concave inner surface upon which is deposited a cathodoluminescent phosphor screen. Due to the high vacuum in the bulb, several tons of atmospheric pressure are exerted on the faceplate causing the bulb to be susceptible to implosion. (The term "implosion" is defined by Underwriter's Laboratory Incorporated as a "rapid and sudden inward bursting of a high-vacuum glass envelope.") It is of the utmost importance in the interest of safety to prevent the bulb from violently imploding should, for example, it be struck by a heavy missile.

There have evolved a number of approaches to implosion protecting color CRT's (cathode ray tubes) of the described type having a conventional bulb (with a flanged faceplate). One approach is implemented in systems referred to as "rimbond" systems. The rimbond system has a metal frame which surrounds the flange found on every conventional faceplate. A small gap between the frame and the faceplate flange is filled with a cement -- typically an epoxy resin. In a rimbond sytem, the frame is not under tension. The cement contains the glass shards of a shattered faceplate long enough to permit gradual (and therefore nonviolent) devacuation of the bulb. Exemplary U.S. patents illustrating rimbond systems are U.S. Pat. Nos. 3,485,407; 3,558,818; 3,412,203 and 3,835,250. A major drawback to rimbond systems has been the large amount of (very costly) epoxy cement required.

A second basic implosion protection approach is termed the "tension band" approach. Systems implementing this approach comprise a band which is placed around the faceplate flange and put under very high tension. The tension band around the faceplate flange constricts the flange and, like the rimbond systems, holds the shards of a fractured faceplate in position until the bulb has gradually-devacuated. Numerous patents have been issued on various aspects of tension band systems. See U.S. Pat. Nos. 3,818,557; 3,456,076; 3,556,306; 3,597,537; 3,777,057; 3,845,530; and 3,890,464.

Another approach is to bond a transparent protective shield over the front surface of the faceplate. Systems following this approach are commonly termed "bonded panel" systems.

Yet another approach to implosion-protecting color CRT's with conventional faceplates involves using an expansible frame and a tension band to constrain the expansibility of the frame. The frame comprises an overlapped air of "C"-shaped half-frames. A viscous epoxy cement is typically applied to each of the half-frames; the half-frames are then placed around the faceplate flange with their ends overlapping. Before the cement has set, a tension band is drawn up tightly around the frame and faceplate flange. It is common to use a lighter weight tension band than is used in a pure tension band system. See U.S. Pat. No. 3,845,530—Platt.

A U.S. Pat. No. 3,647,960 — Takemoto et al. discloses still another implosion protection system for a color CRT of the type having a conventional bulb with a flanged faceplate. The implosion system of Takemoto et al. comprises a series of closely spaced, mutually insulated turns of wire wrapped (with or without tension) around and adhered to the flange of the faceplate.

A patent to Powell et al. — U.S. Pat. No. 3,519,161 discloses the use of a limited number of turns of reinforcing wire around the flange of a color CRT faceplate of the conventional type to enhance the resistance of the tube to implosion.

U.S. Pat. No. 3,166,211 — Stel et al. discloses an implosion protection system for a CRT comprising a fiber-impregnated sheath on the exterior of the CRT bulb. In one embodiment, glass fibers are embedded in a cord which is wrapped around and bound to the exterior of a tube to provide implosion protection.

Yet another implosion protection system for a conventional CRT bulb is disclosed in U.S. Pat. No. 3,220,593 in which a webbing material is glued to a substantial portion of the funnel and to the faceplate flange. A tension band is applied around the flange of the faceplate and over the webbing material. Systems such as this have apparently not met the rigid test of commercial use; to my knowledge, no such system has found a practical application in the color television picture tube market. Other U.S. patents disclosing the use of a webbing material in an implosion protection system for a color CRT are U.S. Pat. Nos. 3,206,056 and 3,314,566.

This invention has exclusive application to a nonconventional color CRT bulb having a flangeless faceplate, as shown, e.g., in U.S. Pat. No. 3,912,963. The referent copending applications Ser. Nos. 639,741; 623,852; 623,853; 623,854; 632,559; and 714,055 disclose a number of implosion protection systems for a bulb of such character. The systems disclosed in those applications, however, do not exploit the principles of the present invention.

A U.S. Pat. No. 2,222,197 to Engels discloses a CRT in which the bulb comprises a flangeless faceplate inset in an expanded open end of a cooperating funnel. A band allegedly providing implosion protection surrounds the outside of the funnel near the open end thereof.

OBJECTS OF THE INVENTION

It is an object of the present invention to provide for a color television picture tube an improved system for implosion protection. Specifically, it is an object to provide an effective and low cost implosion protection system for a color television picture tube having a flangeless faceplate.

BRIEF DESCRIPTION OF THE DRAWINGS

The features of the invention which are believed to be novel are set forth with particularity in the appended claims. The invention, together with further objects and advantages thereof, may best be understood, however, by reference to the following description taken in conjunction with the accompanying drawings, and in which:

DESCRIPTION OF THE PREFERRED EMBODIMENT

This invention is directed to an implosion protection system for a color CRT having a particular kind of nonconventional bulb. Specifically, the bulb includes an approximately rectangular, flangeless, three-dimensionally curved faceplate having a convex front surface and a concave rear surface and having an edge surface which arches away from a reference plane connecting the four corners of the faceplate. The bulb has a funnel with a convex seal land which mates with the concave inner surface of the faceplate.

As is evident from the discussion above, prior art implosion protection systems, with few exceptions (to be discussed) rely for their implosion protection capability upon containment of the entire periphery of the faceplate and/or funnel in order to retain in position the shards of a shattered faceplate until the bulb gradually devacuates.

Implosion protection systems for a nonconventional bulb having a flangeless faceplate have relied for the most part on containment of the entire periphery of the faceplate and/or funnel. Examples are found in the referent copending applications and the above-discussed U.S. Pat. No. 2,222,197—Engels.

As will be described in detail, the present implosion protection system is exclusively useful with a CRT bulb of the nonconventional type having a flangeless faceplate and is characterized by a lack of significant (if any at all) containment of the faceplate periphery. A tension member which surrounds the faceplate in straight lines between the faceplate corners is placed under high tension to produce radially inwardly directed force components on the faceplate corners. The application of high, radially inwardly directed force components on the faceplate corners alone effects a substantial amount of implosion protection for the bulb, in spite of the absence of significant containment of the edge surfaces of the faceplate.

Figures 1, 2:
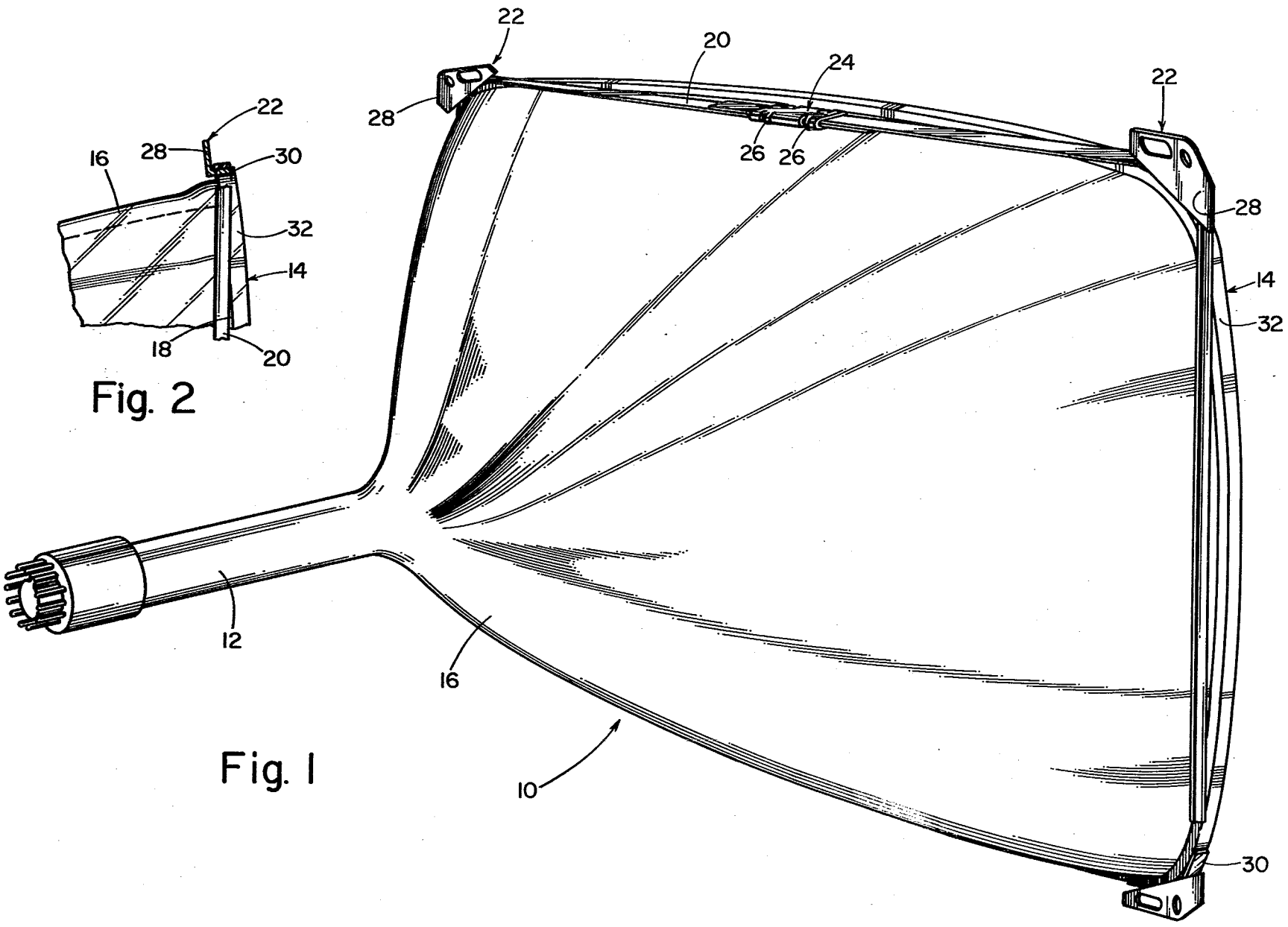
FIG. 1 is a schematic rear perspective view of a color cathode ray tube incorporating a preferred embodiment of the present invention.
FIG. 2 is a section view taken along lines 2—2 in FIG. 1.

FIG. 1 illustrates a preferred application of the principles of the present invention to a tube having a nonconventional bulb 10. The bulb 10 has a conventional neck 12, but has a nonconventional, three-dimensionally curved flangeless faceplate 14 and a funnel 16 with a convex seal land which mates with the concave inner surface 18 of the faceplate 14.

In accordance with the present invention, the bulb 10 includes an implosion protection system comprising a tension member which surrounds the faceplate in straight lines between the faceplate corners, and means for retaining the tension member on the faceplate corners. Specifically, whereas the tension member may take many forms other than are illustrated, it is here shown as taking the form of a tension band 20. The band 20 is retained on the corners of the faceplate by a plurality of brackets 22, one being located at each corner of the faceplate.

The tension band 20 is preferably a steel band. The tension band 32 may be composed of high tensile strength steel. A tension band as described is quite rigid and will tend to elongate very little under the impact of a high energy fracture impulse.

To position the tension band 20 on the bulb, it is placed over the brackets 22. The band 20 may be tensed by any suitable tensioner such as the commercially available N-134 TV tensioner made by Signode Corporation. The tension in the band 20 is preferably in the range of 1800 to 2600 pounds.

In order to retain the tension in the band 20, a seal 24 of the heavy duty type may be employed. A number of notches 26, here shown as being four in number, are made in the seal 24 and in the embraced ends of the tension band 20. The tension band, and the way in which it is tensed and sealed are well known in the art. For more details on the structure and method of application of tension bands for implosion protection systems, reference may be had to U.S. Pat. No. 3,890,464.

The brackets 22 each include an apertured ear 28 for assisting in mounting the bulb in a television chassis. The brackets 22 each include a flange 30 oriented to generally follow the edge surface 32 of the faceplate around the corner thereof. The flange 30 is cemented, as with an epoxy resin, upon the edge surface corner to secure the bracket 22 to the faceplate.

It is very important to note that unlike prior systems, the tension member (here band 20) along the sides of the faceplate departs from the edge surface 32, taking a straight line path between the faceplate corners. It has been found surprisingly, that in spite of the notable lack of physical containment of the edge surface 32, significant implosion protection is provided.

Figure 3:
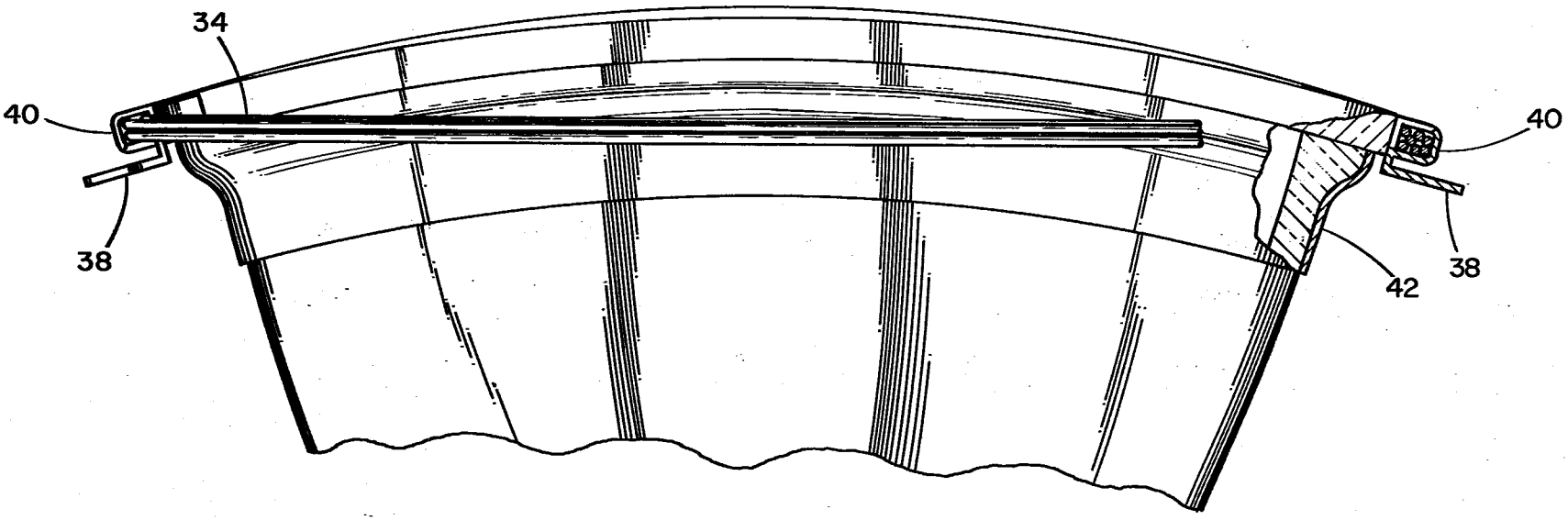
FIg. 3 is a schematic fragmentary side elevational view, partly broken away, of a color cathode ray tube which includes an alternative embodiment of one aspect of the present invention.

FIG. 3 illustrates another embodiment of the invention wherein the tension member is an implosion coil 34 and wherein a crack retarder is provided for enhanced implosion protection.

The coil 34 comprises a plurality of turns of wire drawn directly between corner brackets 38 in a straight line path from corner to corner of the faceplate 14. The wire is preferably placed under considerable tension, for example 50 to 100 pounds per turn. The implosion coil 34 may consist of roughly 20–50 turns of 50–60 mil steel wire.

The brackets 38 are similar to brackets 22, except that there is preferably provided a plurality of integral fingers 40. The fingers 40 receive the turns of wire and are bent down over the coil 34 after it is wound in order to more securely retain it. The fingers 40 are shown in their closed position, i.e., after being bent over the coil 34.

The crack retarder is illustrated as taking the form of a strip of glass fiber tape 42. The crack retarder functions during an implosion to retard the propagation of cracks from the faceplate into the funnel, and to contain funnel shards. Funnel shards have a tendency, if freed, to fly forward through an opening in the faceplate and into the viewing area.

Tests were conducted on an embodiment similar to the FIGS. 3–4 embodiment in which the tension member was an epoxy-bonded cable tensed to 2800 psi gauge pressure (2100 psi actual). A one-inch wide glass fiber tape, as shown at 42, was wrapped around the mouth of the funnel. The recorded test results showed that the tube when hit with a 15 pound missile a small amount of glass was projected into the viewing area — specifically, in a zone 3–5 feet away from the tube a total of 1 gram of glass was found, with the largest piece weighing 0.5 grams.

Tests conducted in which a cable was wrapped around the faceplate edge surface so as to follow its contour and thereby contain the edge surface of the faceplate, were unsuccessful in implosion tests.

The invention is not limited to the particular details of construction of the embodiments depicted and other modifications and applications are contemplated. For example, rather than using a single tension band as shown at 20 in the FIGS. 1-2 embodiment, two or more lighter duty bands may be employed (see U.S. Pat. No. 3,890,464). Other ways than those shown for retaining the tension member on the faceplate corners may be employed. Still other changes may be made in the above-described apparatus without departing from the true spirit and scope of the invention herein involved, and it is intended that the subject matter in the above depiction shall be interpreted as illustrative and not in a limiting sense.

What is claimed is:

1. A color television picture tube having a glass bulb including an approximately rectangular, flangeless, three-dimensionally curved faceplate having a convex front surface, a concave rear surface and an edge surface which, along the sides of the faceplate, arches away from a reference plane connecting the four corners of the faceplate, the glass bulb also having a funnel with a convex seal land which mates with the concave inner surface of the faceplate, said tube having an implosion protection system comprising a tension member which surrounds said faceplate in straight lines between the faceplate corners, and means for retaining said member on the faceplate corners, said system being characterized by said member being under high tension to produce radially inwardly directed force components on the faceplate corners, and by a lack of significant physical containment of the edge surface of the faceplate along the sides thereof.

2. The apparatus defined by claim 1 wherein said tension member comprises a metal cable.

3. The apparatus defined by claim 1 wherein said means for retaining said member comprises metal brackets cemented on said edge surface of said faceplate, one at each corner thereof.

4. A color television picture tube having a glass bulb including an approximately rectangular, flangeless, three-dimensionally curved faceplate having a convex front surface, a concave rear surface and an edge surface which, along with sides of the faceplate, arches away from a reference plane connecting the four corners of the faceplate, the glass bulb also having a funnel with a convex seal land which mates with the concave inner surface of the faceplate, said tube having an implosion protection system comprising a tension member which surrounds said faceplate in straight lines between the faceplate corners, and a bracket affixed on each corner of the faceplate for retaining said member on the faceplate, said system being characterized by said member being under tension to produce radially inwardly directed force components exclusively on the faceplate corners and by a lack of significant physical containment of the edge surface of the faceplate along the sides thereof.

5. A color television picture tube having a glass bulb including an approximately rectangular, flangeless, three-dimensionally curved faceplate having a convex front surface, a concave rear surface and an edge surface which, along the sides of the faceplate, arches away from a reference plane connecting the four corners of the faceplate, the glass bulb also having a funnel with a convex seal land which mates with the concave inner surface of the faceplate, said tube having an implosion protection system comprising:

a tension member which surrounds said faceplate in straight lines between the faceplate corners;

means for retaining said member on the faceplate corners; and a crack retarder located about the circumference of said funnel and bonded thereto, said system being characterized by said member being under tension to produce radially inwardly directed force components on the faceplate corners and by a lack of significant physical containment of the edge surface of the faceplate along the sides thereof.

6. The apparatus defined by claim 5 wherein said crack retarder comprises a web of high tensile strength material.

7. The apparatus defined by claim 5 wherein said means for retaining said member comprises a bracket cemented on each corner of said faceplate.

* * * * *